US005351846A

United States Patent [19]

Carter

[11] Patent Number: 5,351,846

[45] Date of Patent: Oct. 4, 1994

[54] SIDEWALL STRUCTURE FOR STACKABLE BIN

[75] Inventor: Alan T. Carter, Sturgis, Mich.

[73] Assignee: Carter Associates, Inc., Sturgis, Mich.

[21] Appl. No.: 76,817

[22] Filed: Jun. 14, 1993

Related U.S. Application Data

[63] Continuation-in-part of Ser. No. 891,446, May 29, 1992, abandoned.

[51] Int. Cl.[5] ..... B65D 19/18

[52] U.S. Cl. ..... 220/6; 220/453; 220/443; 220/4.29

[58] Field of Search ..... 220/453, 443, 441, 6, 220/1.5, 4.29, 666, 645

[56] References Cited

U.S. PATENT DOCUMENTS

| | | | |
|---|---|---|---|
| 2,068,771 | 1/1937 | Sherman | 220/453 |
| 2,954,913 | 10/1960 | Rossman | 220/453 |
| 3,643,856 | 2/1972 | Jones | 220/441 |
| 4,586,627 | 5/1986 | Grigsby | 220/443 |
| 4,595,137 | 6/1986 | Kupersmit | 220/441 |
| 4,635,815 | 1/1987 | Grigsby | 220/443 |
| 4,643,314 | 2/1987 | Kidd | 220/6 |
| 4,673,087 | 6/1987 | Webb | 220/4.29 |
| 4,700,862 | 10/1987 | Carter et al. | 220/6 |
| 4,828,132 | 5/1989 | Francis, Jr. et al. | 220/6 |
| 5,042,713 | 8/1991 | Stafford | 220/441 |

FOREIGN PATENT DOCUMENTS

| | | | |
|---|---|---|---|
| 2155442 | 6/1973 | Fed. Rep. of Germany | 220/441 |

*Primary Examiner*—S. Castellano

*Attorney, Agent, or Firm*—Flynn, Thiel, Boutell & Tanis

[57] ABSTRACT

An improved collapsible sidewall structure for a stackable bin having a sidewall which is of a two-ply construction defined by inner and outer layers, each being extruded plastic layers having inner and outer sheets joined by transversely extending ribs so as to define elongated flutes or channels, with one of the inner and outer layers having the flutes projecting horizontally, and the other layer preferably having the flutes projecting vertically. The horizontally fluted layer also defines a corner hinge arrangement of the sidewall structure. The horizontally fluted layer, adjacent the free edge of the vertically fluted layer, is provided with an undercut slot projecting vertically thereof and opening inwardly for communication with the interface between the inner and outer layers. This slot has a vertically elongated reinforcing bar adhesively secured therein.

27 Claims, 4 Drawing Sheets

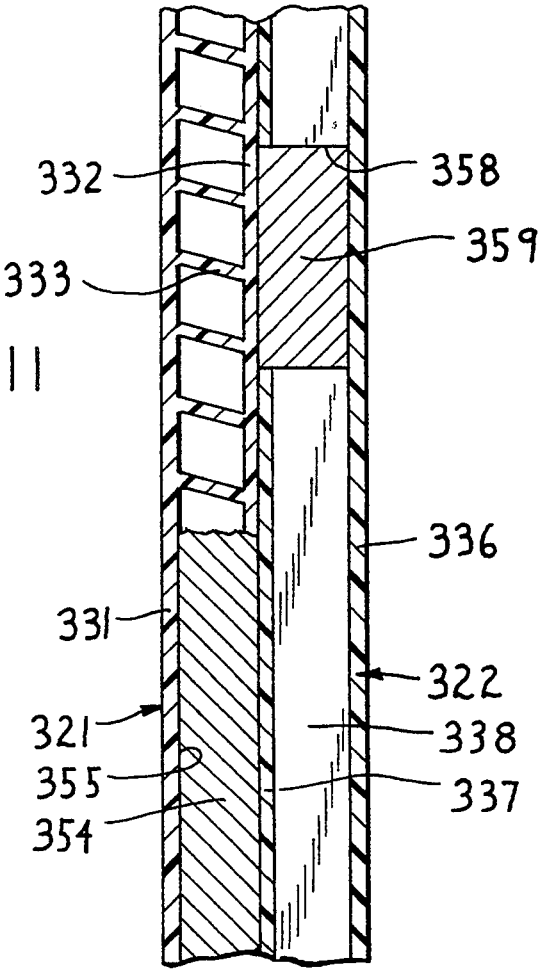
FIG. 11
FIG. 10
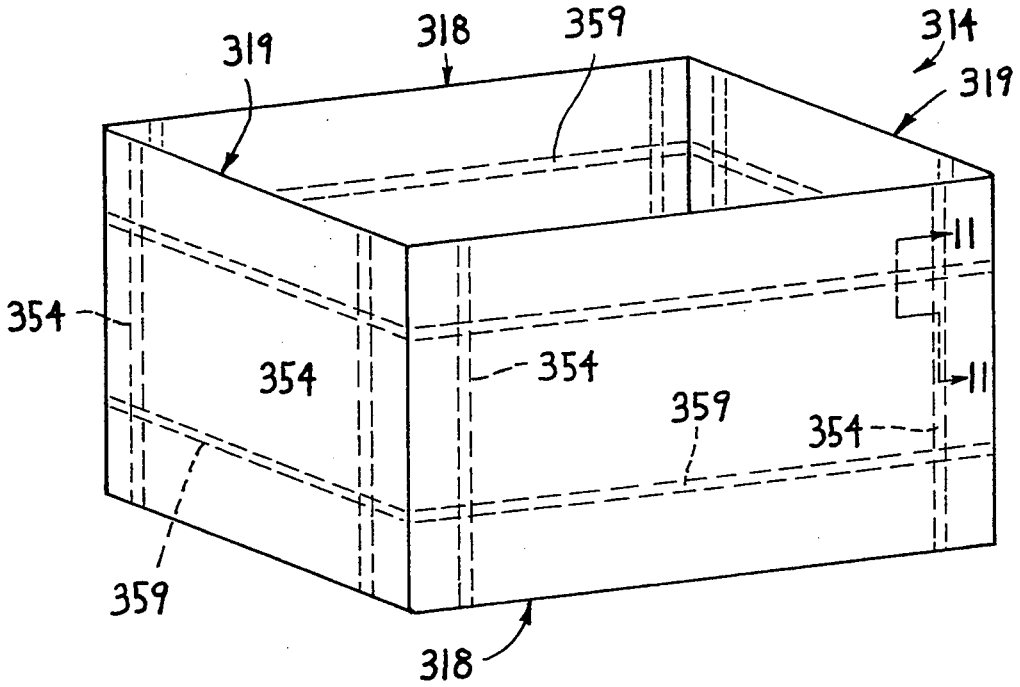

SIDEWALL STRUCTURE FOR STACKABLE BIN

CROSS REFERENCE TO RELATED APPLICATION

This application is a continuation-in-part of copending application Ser. No. 07/891 446 filed on May 29, 1992 now abandoned.

FIELD OF THE INVENTION

This invention relates to an improved collapsible sidewall structure which removably cooperates with upper and lower supports, such as pallets, to define a stackable storage bin.

BACKGROUND OF THE INVENTION

U.S. Pat. No. 4,700,862, as owned by the Assignee hereof, illustrates therein a stackable bin which has met with significant commercial success, and which has proven highly desirable for permitting storage of product therein in such a fashion as to permit shipment between locations, and storage at a selected location. The stackable bin employs an upright hollow wall structure, normally a four-sided wall structure, which is removably positioned between upper and lower pallet-like supports. This wall structure is provided with four corner folds, and may optionally be provided with two intermediate folds to facilitate collapsing of the sidewall structure. Each sidewall of the sidewall structure is defined by a three-ply laminate defined by inner and outer layers fixedly and coextensively secured to opposite sides of an intermediate layer. The inner and outer layers each include inner and outer facing sheets joined by transversely extending ribs, with these inner and outer layers being preferably constructed of plastic formed as a profile extrusion. The intermediate layer is preferably of a light-weight rigid foam. The inner and outer layers are preferably oriented so that the ribs, and hence the tubular profiles defined by the ribs in the facing sheets, extend generally vertically. This prior art structure performed in a desirable manner, and has met with significant commercial success.

As an improvement to this prior art structure, the Assignee previously modified the sidewall structure so that, while the sidewalls were still of the same basic three-ply construction, nevertheless the one-ply corners were modified so as to be defined by a separate corner piece which was oriented so that the ribs or flutes projected horizontally, rather than vertically as in the device of U.S. Pat. No. 4,700,862.

In addition, this modified prior art structure was also sometimes provided with a metal reinforcing rod extending vertically thereof adjacent the end of each sidewall. This metal reinforcing rod was positioned within the three-ply construction, namely between the inner and outer layers, and was disposed directly between opposed ends of the intermediate foam layer and the one-ply corner member. This construction provided increased stacking strength, but still utilized the same three-ply sidewall construction.

In another prior structure, the sidewall structure of the stackable bin is of a two-ply construction formed by two layers of fluted plastic bonded together, with elongate metal rods of cylindrical cross section inserted vertically into some of the individual flutes in an attempt to increase vertical stacking strength. This constructional arrangement, however, is undesirable since not only is insertion of small cross section metal rods into the flutes a difficult and time consuming operation, but it has been observed that these metal rods are often dislodged, i.e., they tend to slide longitudinally within the flutes, and hence make handling of the sidewall structure more difficult.

While the Assignee's prior structures as explained above have performed in a highly-desirable manner, nevertheless the present invention was developed so as to continually improve upon the sidewall structure associated with stackable bins of this type.

SUMMARY OF THE INVENTION

Accordingly, the present invention relates to an improved collapsible sidewall structure designed for cooperation with a stackable bin of the aforesaid type, which collapsible sidewall structure represents an improvement over the prior aforementioned sidewall structure by permitting use of sidewalls of two-ply construction while at the same time providing a highly desirable stacking strength and durability, More specifically, in a preferred embodiment of the improved collapsible sidewall structure for a stackable bin according to the present invention, the sidewall is of a two-ply construction defined by inner and outer layers, each being extruded plastic layers having inner and outer sheets joined by transversely extending ribs so as to define elongated flutes or channels, with one of the inner and outer layers having the flutes projecting horizontally. The horizontally fluted layer also defines the corner hinge arrangement of the sidewall structure. The horizontally fluted layer, in the region adjacent the free edge of the vertically fluted layer, is provided with an undercut or milled slot projecting vertically thereof and opening inwardly for communication with the interface between the inner and outer layers. This slot has a vertically elongated reinforcing bar disposed, and preferably adhesively, secured therein. In a preferred construction, the flutes of the other layer preferably project vertically.

With the improved and preferred sidewall construction as summarized above, the two plies employing vertical and horizontal flutes provide significant vertical column strength for stacking purposes and also provide the overall sidewall structure with significant strength and durability, particularly at the hinged corners as defined by the horizontally fluted layer. The addition of the vertical reinforcing bars in the vicinity of the corners of the sidewall also provide significantly increased vertical stacking strength, and such bars can be precisely and securely confined by being disposed in a milled slot formed in the horizontally fluted material.

In the improved sidewall construction, as aforesaid, the horizontally fluted layer preferably defines the inner layer, whereas the vertically fluted layer is the outer layer and terminates short of the corners to facilitate use of smaller outer layers which can be more easily handled, thereby simplifying printing and the like on the outer layers. This also simplifies the corner hinge structure.

Other objects and purposes of the invention will be apparent to persons familiar with structures of this general type upon reading the following specification and inspecting the accompanying drawings.

BRIEF DESCRIPTION OF THE DRAWINGS

FIG. 10 is a diagrammatic perspective view illustrating a further variation of a sidewall structure according to the present invention.

FIG. 11 is an enlarged, fragmentary sectional view taken substantially along line 11—11 in FIG. 10.

Figure 1:
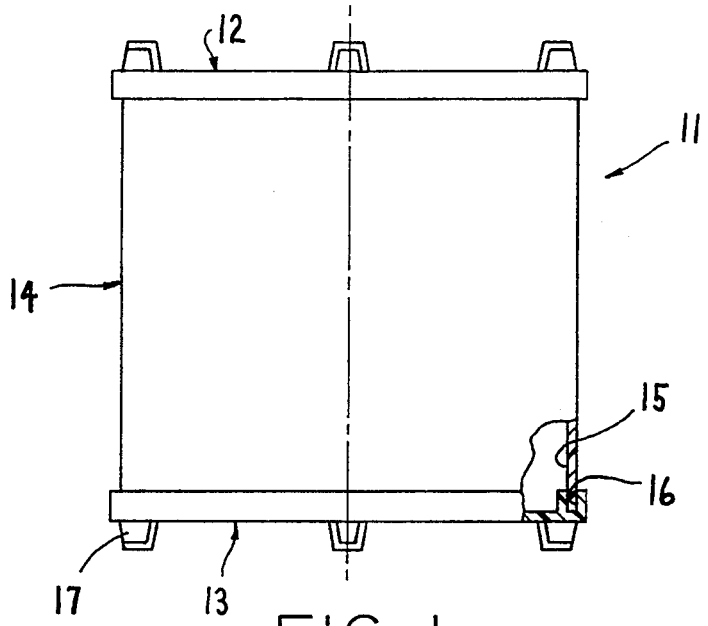
FIG. 1 PRIOR ART
FIG. 1 is an elevational view of a conventional stackable bin employing a tubular sidewall between upper and lower pallet-like supports.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure and designated parts thereof. Said terminology will include the words specifically mentioned, derivatives thereof, and words of similar import.

DETAILED DESCRIPTION

Referring to FIG. 1, there is diagrammatically illustrated a conventional collapsible bin 11 which is typical of many such bins in use. This bin 11 includes top and bottom pallet-like supports 12 and 13, respectively which are typically identical and are generally vacuumed formed of a plastics material. The support pallets 12 and 13 cooperate with a collapsible sidewall structure 14, the latter when opened having a tube-like configuration defining a vertical opening therethrough, with ends of this opening being closed by the pallets 12 and 13. This sidewall structure 14, and its cooperation with the top and bottom support pallets, define an interior storage compartment 15. The support pallets typically have structure which cooperate to define an opening or recess 16 around the edge thereof so as to sidewardly confine the edge of the sidewall structure 14 therein so as to maintain the latter in its open or noncollapsed position.

The bin 14, when assembled as described above, is often secured by bands or other wrapping so as to provide more secure engagement of the pallets to opposite ends of the sidewall structure. Further, for both transporting and storing, plurality of such bins are often disposed in vertically stacked relationship, and the sidewall arrangement 14 must accommodate vertical compression loads which are transmitted therethrough due to bins stacked vertically thereabove. The pallets 12 and 13 typically are provided with support legs 17 disposed adjacent each corner of the pallet, which legs can supportingly engage a support surface such as a floor, or permit direct supportive engagement between vertically-stacked bins. These legs, which are typically disposed in three rows each containing three uniformly spaced legs, provide spaces therebetween for accommodating the fork of a forklift vehicle.

Figure 2:
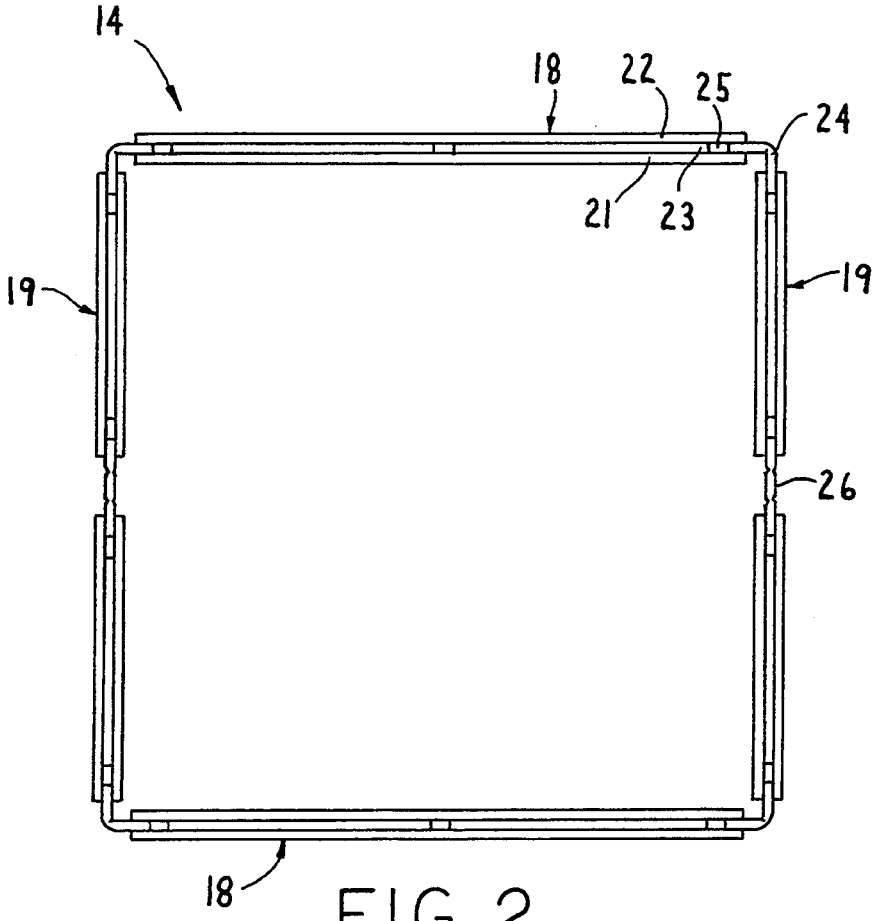
FIG. 2 PRIOR ART
FIG. 2 is a plan view of a known six-fold collapsible sidewall structure.

A known sidewall arrangement 14 is illustrated in greater detail in FIG. 2 and includes parallel sidewalls 18 which are joined together by end walls 19, the latter being substantially parallel and extending substantially perpendicularly between the sidewalls when the sidewall structure is in its open vertically-oriented condition. Each of the walls 18, 19 is of a three-ply construction defined by inner and outer layers 21 and 22 which are adhesively secured or bonded to opposite sides of an intermediate or middle layer 23. Each of the inner and outer layers 21, 22 are extruded plate-like plastic members having parallel facing sheets joined together by a plurality of transversely extending ribs so that the layer has a plurality of parallel channels extending therethrough, this overall plate-like member being often referred to as a "fluted" construction. The fluted construction of inner and outer walls 21 and 22 are both oriented so that the flutes (i.e., the ribs and channels) extend generally vertically of the container. The intermediate layer 23 is a plate-like member which is constructed of plastic material specifically a sheet of rigid plastic foam which extends substantially coextensively with and between the inner and outer layers. This foam sheet 23 is typically expanded polystyrene.

Each adjacent pair of walls 18 and 19 are joined by a corner structure 24 which defines a vertical corner hinge. This corner hinge 24 is constructed by a sheet of extruded fluted plastic substantially identical to the structure of layers 21 and 22, except that the flutes of corner member 24 extend horizontally to provide improved strength for the vertically-extending hinge. Each end of the hinge member 24 is joined to the respective wall 18 or 19 by projecting inwardly by a small horizontal extent so as to be adhesively secured to and between the inner and outer layers 21 and 22. The end of the hinge 24 is thus sandwiched between the inner and outer layers and is generally aligned with the adjacent end of the intermediate layer 23. To provide increased vertical stacking strength, a vertically-elongate metal reinforcing bar 25 is sometimes inserted between the inner and outer layers 21 and 22 so as to be disposed directly between opposed ends (i.e., edges) of the intermediate layer 23 and the corner member 24. The illustrated sidewall arrangement 14 of FIG. 2 is a six-fold arrangement in that each end wall 19 includes front and rear portions which are joined together by an intermediate hinge member 26, the latter being a horizontally fluted plastic member which is substantially identical to the corner hinge member 24 and joins to the adjacent front and rear portions of the end wall as described above relative to the corner hinge member. This intermediate hinge member 26 permits the end walls to hinge inwardly between the sidewalls so that the complete sidewall arrangement can be collapsed.

Figure 3:
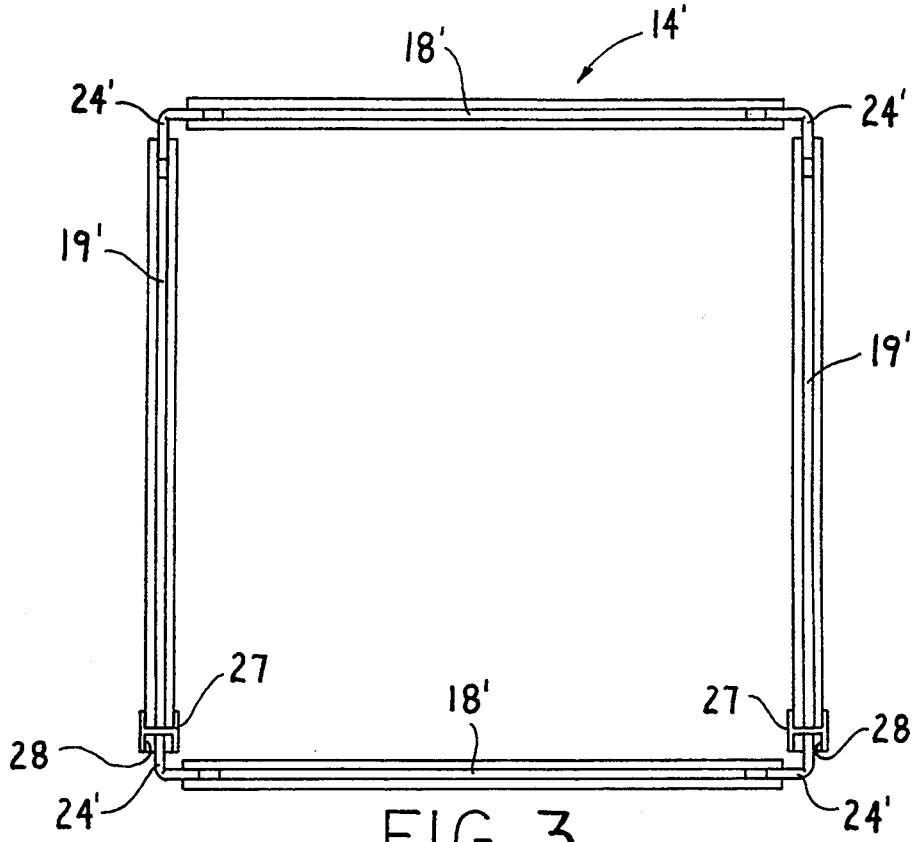
FIG. 3 PRIOR ART
FIG. 3 is a plan view of another known sidewall structure for a stackable bin of this general type, which plan view relates to a sidewall structure of the type having a removable front wall or gate.

FIG. 3 illustrates another prior art sidewall arrangement 14' which cooperates to define a bin in the same manner as illustrated by FIG. 1. This sidewall arrangement 14' however, employs a removable sidewall or gate which provides access to the interior thereof and also permits collapsed storage of the sidewall arrangement. This arrangement 14' again includes side and end walls 18' and 19' which are of a three-ply construction substantially identical to that utilized in the sidewall 14 of FIG. 2, with adjacent walls being joined together by corner hinge members 24'. However, the one sidewall 18' (the lowermost sidewall in FIG. 3) functions as a removable wall or gate. For this purpose, each of the end walls 19' is provided with a generally H-shaped edge element 27 secured to and extending vertically along the front edge thereof. This edge member 27, which is typically constructed of metal, defines therein an outwardly opening channel or groove 28 into which projects the free edge of the corner hinge member 24' associated with the removable sidewall.

Considering now the improved sidewall arrangement of the present invention, and referring specifically to FIGS. 4–7, the improved sidewall arrangement 114 is in many respects similar to the sidewall 14 and similar reference numerals, increased by "100", have been used to designated corresponding parts.

This sidewall arrangement 114 again includes generally parallel sidewalls 118 joined together by generally parallel end walls 119 so that the opened tubular sidewall arrangement is of a generally rectangular configuration. Each of the walls 118 and 119 is of a two-ply construction.

More specifically, each wall 118 and 119 (FIGS. 5–7) includes an inner layer 121 and an outer layer 122 which are directly overlapping and adhesively bonded or secured together. The inner layer 121 of each wall 118 and 119 is again defined by a "profile" type plastic extrusion which includes generally parallel facing sheets 131 and 132 which are joined together by transversely extending ribs 133 so as to define channels 134 therebetween. This inner layer 121 is oriented so that the fluted construction thereof, namely the longitudinal direction of the ribs 133 and channels 134, is oriented horizontally when the sidewall arrangement 114 is in its upright use position.

The outer layer 122 is also constructed of a "profile" type plastic extrusion substantially the same as the layer 121 in that it includes generally parallel facing sheets 136 and 137 which are rigidly joined by transversely extending ribs 138 which cooperate to define longitudinally extending channels 139. The outer layer 122 is oriented with its fluted construction extending perpendicularly relative to the fluted construction of the inner layer 121. That is, the ribs 137 and channels 138 which define the flutes in the outer layer 122 are oriented so as to extend vertically when the sidewall arrangement 114 is in its open upright position of use.

The opposed faces 132 and 137 directly contact and overlie one another, and are fixedly secured together by a suitable adhesive or bonding agent.

The adjacent walls 118 and 119 are joined by a corner hinge member or portion 124 which defines therein one or more vertically-extending hinge creases 141 to facilitate forming of a foldable 90° corner. This corner hinge portion 124 is of a fluted plastic construction identical to that of the inner layer 121 and in fact the flutes of the corner portion 124 also extend horizontally. This corner hinge member 124 includes hinge leafs 142 which are disposed on opposite sides of the hinge grooves 141 and which project horizontally so as to directly overlap the outer layer 122 and hence are aligned with and effectively constitute extensions of the inner layer 121. In fact, in the illustrated and preferred embodiment, the corner member 124 is integral with and constitutes a portion of the plate-like member defining the inner layer 121.

Figure 4:
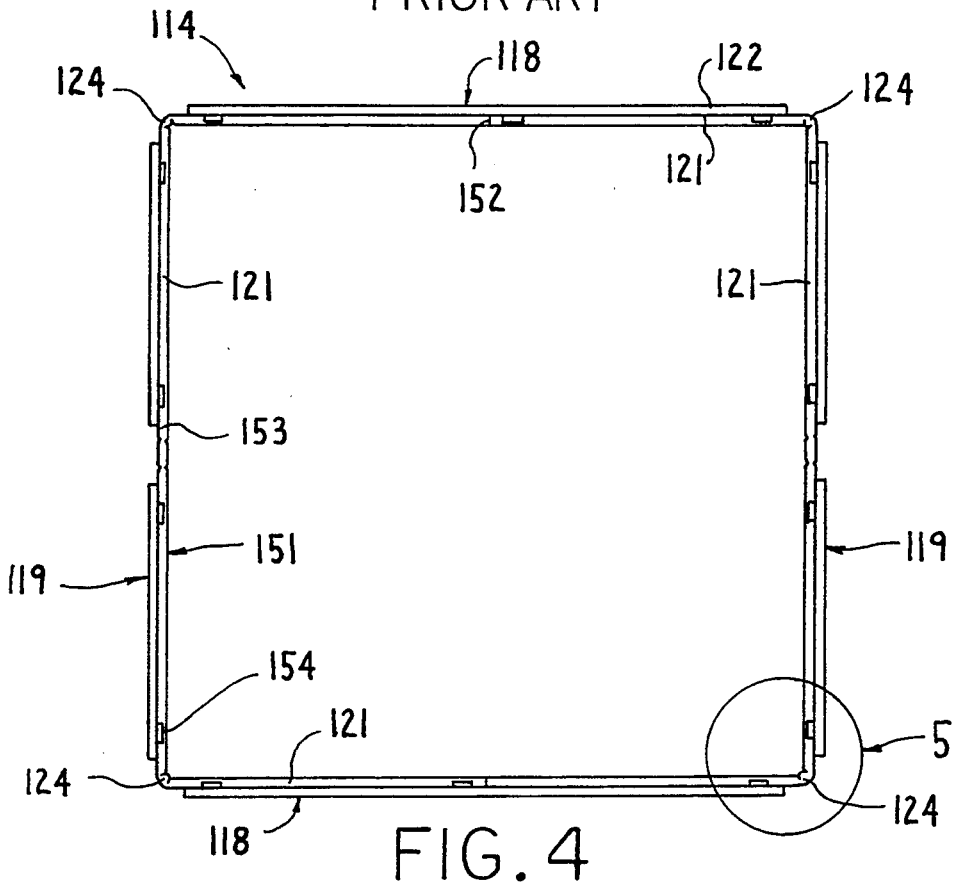
FIG. 4 is a plan view of a six-fold collapsible sidewall structure according to the present invention.

More specifically, and as illustrated by FIG. 4, the inner layers 121 which define the four sidewalls 118 and 119 together with the four corner members 124 define a generally closed tube which is structurally defined by only two fluted plate-like sheets 151. Each of these sheets 151 defines the inner layer 121 for one of the end walls 119, and also defines approximately one-half of the inner layer 121 of both sidewalls 118. The adjacent ends of the two sheets 151 substantially directly abut at 152, which abutting ends are located substantially at the middle of the sidewalls 118. In the embodiment illustrated by FIG. 4, each of the sheets 151 also includes a center portion 153 which is an integral part of the inner layer 121 of each end wall 119, and this center portion 153 defines a vertical hinge for permitting inward folding of the end walls 119 when collapsing of the sidewall structure is desired. The outer layer 122 of each end wall 119 is separated into two distinct sections which terminate short of the center hinge section 153.

To increase stacking strength and particular vertical force transfer through the sidewall arrangement when bins are stacked on top of one another, particularly since the sidewall arrangement is of a two-ply construction employing one horizontally fluted layer and one vertically fluted layer, the side and end walls 118 and 119 are additionally provided with metal (i.e., steel or aluminum) reinforcing rods or bars 154 which extend vertically throughout the height of the sidewall arrangement.

More specifically, each side and end wall 118 and 119, in close proximity to each corner member 124, is provided with a reinforcing rod 154 intimately bonded into the two-ply laminate and disposed so as to be positioned substantially directly over one of the corner legs of the pallet. This reinforcement is accomplished by providing a vertically-elongate groove 155 (FIG. 5) which is preferably formed so as to extend vertically across one face of the horizontally fluted layer 121. This groove 155 is formed so as to open inwardly from the facing sheet 132, with the groove having a depth which extends across a majority of the thickness of the layer 121 but has the bottom of the groove closed off by the other facing sheet 131. The groove 155, which is preferably formed by being milled into the layer 121 from the inner side face 132 thereof, has a width which closely conforms with the width of the reinforcing rod 154, the latter having a thickness which substantially corresponds to the depth of the groove. This reinforcing rod 154 fits snugly in the groove 155, and is preferably adhesively secured in the groove, such as by being secured to the bottom of the groove 155 and to the opposed facing sheet 137 of the outer layer 122. Defining the groove 155 in the horizontally fluted layer 121 is preferred since it is easier to machine or mill the groove in transverse relationship to the ribs, and a groove of precise width can thus be milled inasmuch as the adjacent ends of the ribs function to retain the reinforcing rod 154 at the proper position in the groove.

Further, positioning the vertically fluted sheet 122 outermost is preferred since the outer sheets are smaller than the inner sheets 151, and thus this facilitates the handling of these sheets, particularly since it is often times desirable to print information on the outer sheets prior to laminating them to the inner layer.

As illustrated by FIG. 4, the reinforcing rod 154 is provided in each wall 118 and 119 in the vicinity of each corner, with the rod being defined in the two-ply laminated portion of the wall closely adjacent the vertical free edge of the outer layer 122. In addition, a further rod can be laminated into and between the two layers substantially at the horizontal mid-point thereof, which rod is again preferably disposed within a vertical groove milled into the horizontally fluted inner layer 121.

In a typical construction, each of the fluted layers 121 and 122 has a thickness of about ¼ inch, and these fluted layers are typically constructed of polypropylene. Further, the metal reinforcing rod 154 will have a thickness of about 3/16 inch and a width of about 1 inch, although the width may be increased or decreased depending upon the desired vertical stacking strength. This reinforcing rod 154 will, however, normally and preferably have a width which is several times greater than its thickness. By bonding the reinforcing rod 154 into the groove 155, the rod totally fills the milled groove and eliminates any weakness created in the layer 121 by formation of the groove, and at the same time the rod maximizes the vertical compression strength of the sidewall structure due to the rod having opposite sides thereof bonded to the inner and outer layers so as to provide a unitized structure possessing greater strength.

Figure 9:
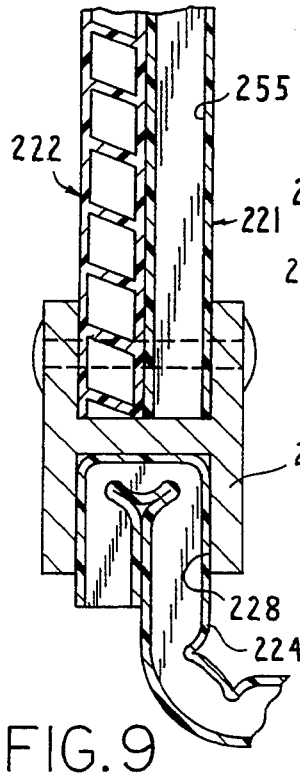
FIG. 9 is an enlarged, fragmentary sectional view of the corner portion of the sidewall as enclosed by the circle designated 9 in FIG. 8.
Figure 8:
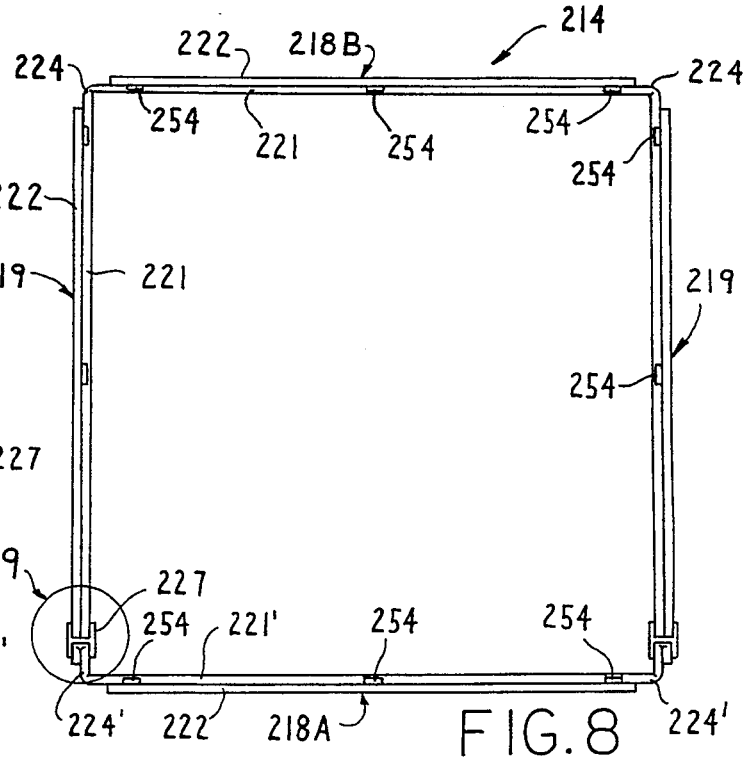
FIG. 8 is a top plan view of a variation of the sidewall structure wherein the latter is formed with a removable sidewall or gate.
Figure 7:
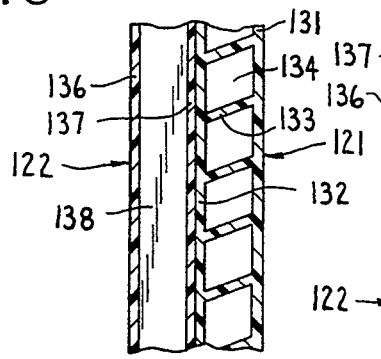
FIGS. 6 and 7 are fragmentary sectional views taken substantially along lines 6—6 and 7—7, respectively, in FIG. 5.
Figure 6:
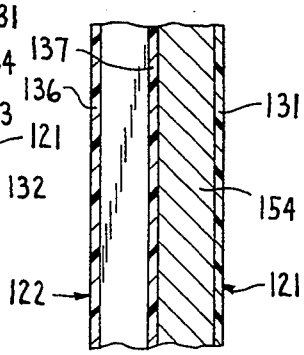
Figure 5:
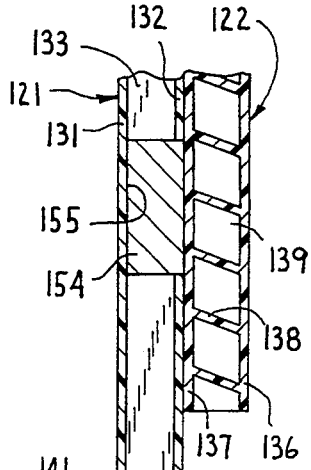
FIG. 5 is an enlarged, fragmentary sectional view through the corner portion of the sidewall structure as identified by the circle 5 in FIG. 4.
Figure 5:
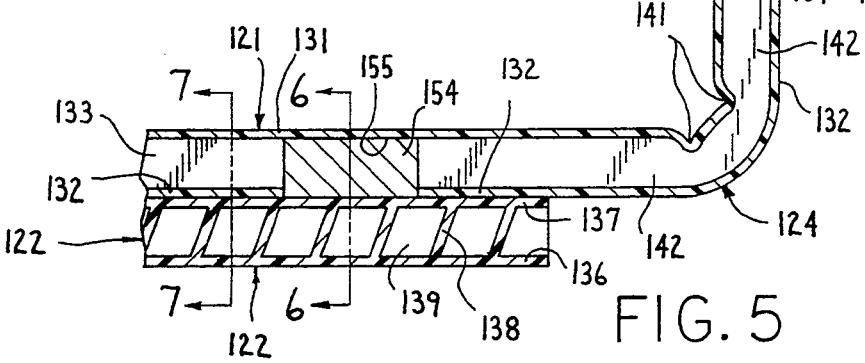

Referring now to FIGS. 8 and 9, there is illustrated a variation of the invention. In this variation the sidewall structure 214 includes opposed sidewalls 218 which are generally parallel and joined together by opposed end walls 219. The front sidewall designated 218A is removable so as to function as a door or gate, whereas the rear sidewall 218B is integrally joined through corner members 224 to the adjacent end walls 219.

Each of the walls 218 and 219 is of a two-ply construction which is substantially identical to that of the sidewall arrangement 114 identified above. That is, each sidewall includes an outer layer 222 which is substantially coextensive with and adhesively secured to an inner layer 221, the latter being integral with the corner portions 224. The inner layer is of a fluted plastic material, with the flutes extending horizontally thereof and into and around the corner members 224, whereas the outer layer 222 has the flutes thereof oriented vertically. The inner layer 221 defining the opposed end walls 219 and the rear wall 218B, and the corner portions 224 joining same, can and preferably is formed from a continuous one-piece sheet of material.

As to the front sidewall 218A, it includes a vertically fluted outer layer 222 which coextensively extends over and is bonded to the outer surface of a horizontally fluted inner layer 221', the latter having corner portions 224' integrally joined thereto. These corner portions 224', however, terminate in folded-over two-ply free edges (FIG. 9) which are adapted to be slidably inserted into vertical channels 228 which are formed in the metal H-shaped edge members 227 which are fixed to and extend vertically along the front free edge of each end wall 219. This channel 228 accommodates therein the free edge of the end wall 219 and is fixedly secured thereto, as by riveting.

Each of the end walls and sidewalls, in the vicinity of the respective corner 224 or 224', is provided with a metal reinforcing rod 254 adhesively secured within a groove 255 which is milled inside the laminate, specifically within the inner horizontally fluted layer 221 or 221'. However, the front free edges of the sidewalls 219 are not provided with a metal reinforcing rod laminated therein since the metal H-channel 228 effectively functions for increasing the vertical load strength of the sidewall arrangement.

The sidewall arrangement 214 is positioned between and cooperates with top and bottom support pallets in the same manner as described above. When the sidewall arrangement 214 is confined between the top and bottom pallets, the front sidewall 218A is prevented from separating from the remainder of the sidewall arrangement.

Referring now to FIGS. 10 and 11, there is illustrated a further variation of a sidewall structure according to the present invention. In this variation the sidewall structure or arrangement is in many respects similar to the sidewall arrangements described above, and hence the same two-digit reference numerals prefixed by a "3" have been used to designate corresponding parts.

In the variation of FIGS. 10 and 11, the sidewall structure 314 includes opposed sidewalls 318 which are generally parallel and joined together by opposed side or end walls 319. The sidewall structure 314 is of an open tubular configuration similar to the sidewall structures described above, but is illustrated only diagrammatically in FIG. 10 since it will be appreciated that the sidewall structure 314 may be constructed either as a six-fold arrangement similar to FIG. 4 or may be constructed having a removable sidewall similar to the arrangement of FIG. 8.

In this variation, each wall 318 and 319 is again of a two-ply construction which is substantially identical to the sidewall arrangement 114 described above. That is, each sidewall 318 and 319 includes an outer layer 322 which is substantially coextensive with and adhesively secured directly to an inner layer 321, the latter preferably being integral with the corner portions of the sidewall structure, similar to the corner portions 124 and 224 described above.

The inner layer 321 is of a fluted plastic material, with the flutes preferably extending horizontally thereof and into and around the corners of the sidewall structure, whereas the outer layer is also of a fluted plastic material but normally has the flutes thereof oriented vertically.

As illustrated by FIG. 11, the inner layer 321 is again defined by thin parallel facing sheets 331 and 332 which are rigidly joined together by transversely extending ribs 333, which ribs extend horizontally in generally parallel relationship with one another, with the layer 321 preferably being formed from a continuous one-piece sheet of plastic material, such as by being extruded.

The outer layer 322 is similarly formed and includes plastic facing sheets 336 and 337 which are joined by transversely extending ribs 338, the latter extending vertically in generally parallel relationship to one another. These inner and outer layers are constructed in the same manner as described above relative to the layers 121 and 122.

The inner layer is preferably provided with grooves 355 formed therein, such as by milling, which grooves extend vertically throughout the entire height of the inner layer and open inwardly through the facing sheet 332 and also through a majority of the depth of the ribs 333. The groove 355 extends generally perpendicularly relative to the ribs 333, and the bottom of the groove is closed off by the other facing sheet 331. A groove 355 is preferably provided in the inner layer 321 of each sidewall 318 and 319 in the vicinity of each corner, and each groove has a metal reinforcing rod or bar 354 disposed therein so as to substantially totally occupy the groove. The metal reinforcing bar 354 extends vertically throughout the height of the sidewall arrangement and is adhesively bonded into the two-ply laminate so as to be totally sandwiched interiorly of the laminate, with the mouth of the groove in the inner layer 321 being closed by the outer layer 322 so as to sandwich the reinforcing bar into the laminate, in the same manner as described above relative to FIGS. 4–9.

In this variation of FIGS. 10 and 11, the sidewalls 318 and 319 are also preferably provided with horizontally extending reinforcing bars 359 associated with and integrated interiorly of the two-ply laminate. To accomplish this, the outer layer 322 is provided with a groove 358 formed therein, as by milling, with the groove extending horizontally of the outer layer 322 so as to extend generally perpendicularly relative to the ribs 338 of the outer layer. This groove 358 opens inwardly through the facing sheet 337 and has a depth so as to extend through a majority of the ribs 338, with the groove being closed by the other facing sheet 336. The reinforcing bar 359 is of metal and generally has a rectangular cross sectional configuration similar to the bars 154, 254 and 354 described above. This reinforcing bar 359 is snugly accommodated within the groove 358 and is adhesively bonded to the layer 322, whereby the bar 359 has its one side face disposed substantially flush with the mouth of the groove 358, and hence flush with the outer surface of the facing sheet 337. The outer layer 322 is oriented so that the groove 358 open interiorly of the two-ply laminate, whereby the mouth of the groove 358 is closed off by the inner layer 321.

With the arrangement illustrated by FIG. 11, both the vertical and horizontal reinforcing bars are confined interiorly of the two-ply laminate construction of the sidewall, with the two layers 321 and 322 defining the laminate sidewall being directly adhesively secured to one another so as to interiorly confine the reinforcing bars within the respective grooves. The exposed faces of the reinforcing bars themselves can be adhesively bonded to the opposed facing sheet of the opposed layer.

When reinforcement of the sidewalls in the horizontal direction is required, then each sidewall is preferably provided with at least two reinforcing rods 359 associated therewith, which rods are preferably disposed in vertically spaced relationship so that one is more closely adjacent an upper edge of the sidewall, and the other more closely adjacent the lower edge of the sidewall, as illustrated by FIG. 10. If necessary or desired, a third said rod 359 can be provided so as to extend horizontally along each sidewall, which third rod would normally be disposed substantially vertically midway between the upper and lower edges of the respective sidewall.

Use of horizontal reinforcing rods 359 is particularly desirable in situations where the sidewall structure is being used for confining bulk or flowable materials such as granular materials which impose higher internal pressure or force against the sidewalls. In fact, in situations involving materials of this type, the sidewall structure is preferably provided with the horizontal reinforcing bars 359, even if the vertical reinforcing bars 354 are not necessary and hence eliminated.

When the sidewall structure is of a six-fold arrangement similar to that illustrated by FIG. 4, then the horizontal bars will extend throughout the length of the two outer layers associated with the foldable sidewall, terminating short of the middle sidewall hinge.

While FIGS. 10 and 11 illustrate the vertical and horizontal rods being in the respective inner and outer layers of the sidewall, it will be appreciated that this relationship can be reversed so that the horizontal rod is in the inner layer, and the vertical rod in the outer layer if desired. Under such situation, however, the rods are still preferably positioned it the respective layers so as to extend in perpendicular relationship with respect to the ribs or flutes of the respective layer.

In many instances one of the sidewalls of the bin can be provided with an openable panel or gate, such as associated with the upper portion of the sidewall, so as to permit access to the interior of the bin without requiring removal of the top pallet.

While the preferred embodiment of the sidewall construction according to the present invention employs a two-ply arrangement wherein the flutes of one-ply extend vertically and the flutes of the other ply extend horizontally, there are some instances where the flutes of both plies will be oriented so as to extend horizontally. For example, the bin construction of the present invention has been discovered to be highly desirable for shipping bulk or loose fill materials. Such bulk or loose fill materials are confined within a flexible plastic bag which effectively fills the interior of the sidewall construction, and such materials exert significant outward pressure against the sidewalls. By orienting the flutes of both the inner and outer layers horizontally, then this significantly increases the horizontal beam strength of the sidewalls against bulging by the interior pressure of the loose fill material. At the same time, the metal reinforcing bars associated with the sidewalls provide the necessary stacking or vertical column strength.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a collapsible storage bin having a collapsible sidewall structure which is of generally rectangular shape in horizontal cross section and defines a vertically extending opening therethrough, and upper and lower pallet-like supports removably engaged with respective upper and lower edges of sidewall structure for closing off said sidewall structure and defining a storage compartment therein, said sidewall structure including a pair of substantially parallel sheet-like sidewalls joined together by a pair of sheet-like end walls, the end walls and at least one of the sidewalls having adjacent vertical edges joined together by a corner fold structure which permits relative horizontal swinging movement between the adjacent end walls and said one sidewall for permitting collapsing of the sidewall structure, the improvement comprising:

each said sidewall and end wall being constructed as a two-ply laminate having substantially coextensive inner and outer sheet-like layers directly fixedly secured to and substantially coextensively overlaying one another;

each said inner and outer sheet-like layer being constructed as an extruded plastic member having substantially parallel inner and outer plastic facing sheets joined together by a plurality of substantially parallel plastic ribs which extend transversely between and are rigidly joined to said facing sheets, said ribs and sheets cooperating to define therebetween a plurality of elongated and substantially parallel channels which are enclosed between said facing sheets, the ribs and channels of a first of said inner and outer sheet-like layers being elongated substantially vertically, and the ribs and channels of a second of said inner and outer layers being elongated substantially horizontally;

a predetermined one of said inner and outer sheet-like layers terminating in a free vertically-extending edge disposed closely adjacent a respective said corner fold structure;

a selected one of said inner and outer sheet-like layers of each said sidewall and end wall having a horizontally enlarged groove formed therein and extending vertically thereof adjacent each said free edge, said groove opening inwardly through one of the facing sheets of said selected one layer and also through the ribs disposed thereunder with the bottom of the groove being closed by the other facing sheet of said selected one layer, said groove being confined entirely within the two-ply laminate so that the mouth of the groove is closed off by the other sheet-like layer which is not said selected one layer; and a vertically elongate metal reinforcing rod fixedly positioned within and substantially totally occupying each said groove.

2. A bin according to claim 1, wherein said metal reinforcing rod is adhesively secured to both of said inner and outer sheet-like layers.

3. A bin according to claim 2, wherein said reinforcing rod has a thickness which is less than the thickness of said selected one layer, and said rod when disposed within said groove has a side surface which is substantially flush with the one facing sheet of said selected one layer and is adhesively secured to an opposed facing sheet of the other layer.

4. A bin according to claim 3, wherein the reinforcing rod is of generally rectangular horizontal cross section and has a width which is several times greater than the thickness.

5. A bin according to claim 4, wherein the groove is formed in the layer having the ribs extending horizontally.

6. A bin according to claim 1, wherein said corner fold structure is integral with said second layer having the horizontally extending channels and ribs so that said second layer also defines the corner fold structure.

7. A bin according to claim 6, wherein the groove is formed in said second layer having the ribs extending horizontally.

8. A bin according to claim 7, wherein the metal reinforcing rod has a generally rectangular horizontal cross section having a thickness which is slightly less than the thickness of said second layer and a width which is significantly greater than the thickness of said second layer.

9. A bin according to claim 7, wherein said selected one layer having the groove therein defines said inner layer.

10. A bin according to claim 9, wherein the other sidewall has vertical edges thereof joined to adjacent vertical edges of said end walls through further corner fold structures which are substantially identical to said first-mentioned corner fold structures.

11. A bin according to claim 10, wherein each said end wall has a vertically extending center portion disposed substantially midway between adjacent corners, said vertically extending center portion being of a one-ply thickness defined solely by said inner layer for defining a vertically-extending hinge.

12. A bin according to claim 1, wherein said metal rod is of a generally rectangular horizontal cross section and has a thickness less than the thickness of said one layer and a width which is significantly greater than the thickness of said one layer.

13. A bin according to claim 12, wherein said reinforcing rod has a width which is several times greater than the rod thickness.

14. A collapsible storage bin, comprising:

a collapsible sidewall structure which is of generally rectangular shape in horizontal cross section and defines a vertically extending opening therethrough;

upper and lower pallet-like supports removably engaged with respective upper and lower edges of sidewall structure for closing off said sidewall structure and defining a storage compartment therein;

said sidewall structure including a pair of substantially parallel sheet-like sidewalls joined together by a pair of sheet-like end walls, the end walls and at least one of the sidewalls having adjacent vertical edges joined together by a corner fold structure which permits relative horizontal swinging movement between the adjacent end walls and said one sidewall for permitting collapsing of the sidewall structure;

each said sidewall and end wall being constructed as a two-ply laminate having substantially coextensive inner and outer sheet-like layers directly fixedly secured to and substantially coextensively overlaying one another and respectively defining inner and outer surfaces of the sidewall;

each said inner and outer sheet-like layer being constructed as an extruded plastic member having substantially parallel inner and outer plastic facing sheets joined together by a plurality of substantially parallel plastic ribs which extend transversely between and are rigidly joined to said facing sheets, said ribs and sheets cooperating to define therebetween a plurality of elongated and substantially parallel channels which are enclosed between said facing sheets, the ribs and channels of a first of said inner and outer sheet-like layers being elongated substantially horizontally;

said first sheet-like layer being integrally joined to said corner fold structure so that said corner fold structure is of a one-ply thickness with the ribs of said first layer extending horizontally through the corner fold structure;

a second of said inner and outer sheet-like layers terminating in a free vertically-extending edge disposed closely adjacent a respective said corner fold structure;

one of said inner and outer sheet-like layers, adjacent each said free edge, having a horizontally enlarged groove formed therein and extending vertically thereof, said groove opening inwardly through one of the facing sheets of said one layer and also at least partially through the ribs disposed thereunder with the bottom of the groove being closed by the other facing sheet of said one layer, said groove being confined entirely within the two-ply laminate so that the mouth of the groove is closed off by the other sheet-like layer; and a vertically elongate metal reinforcing rod fixedly positioned within and substantially totally occupying said groove.

15. A bin according to claim 14, wherein said metal reinforcing rod is adhesively secured to both of said inner and outer sheet-like layers.

16. A bin according to claim 15, wherein said reinforcing rod has a thickness which is less than the thickness of said one layer, and said rod when disposed within said groove has a side surface which is substantially flush with the one facing sheet of said one layer and is adhesively secured to an opposed facing sheet of the other layer.

17. A bin according to claim 16, wherein the groove is formed in the layer having the ribs extending horizontally.

18. A bin according to claim 14, wherein said metal rod is of a generally rectangular horizontal cross section and has a thickness less than the thickness of said one layer and a width which is significantly greater than the thickness of said one layer.

19. A bin according to claim 18, wherein said reinforcing rod has a width which is several times greater than the rod thickness.

20. A collapsible storage bin, comprising:

a collapsible sidewall structure which is of generally rectangular shape in horizontal cross section and defines a vertically extending opening therethrough;

upper and lower pallet-like supports removably engaged with respective upper and lower edges of sidewall structure for closing off said sidewall structure and defining a storage compartment therein;

said sidewall structure including a pair of substantially parallel sheet-like sidewalls joined together by a pair of sheet-like end walls, the end walls and at least one of the sidewalls having adjacent vertical edges joined together by a corner hinge structure which permits relative horizontal swinging movement between the adjacent end walls and said one sidewall for permitting collapsing of the sidewall structure;

each said sidewall and end wall being constructed as a two-ply laminate having substantially coextensive inner and outer sheet-like layers directly fixedly secured to and substantially coextensively overlaying one another and respectively defining inner and outer surfaces of the sidewall, said inner and outer layers having overlapping width and height dimensions;

each said inner and outer sheet-like layer being constructed as an extruded plastic member having substantially parallel inner and outer plastic facing sheets joined together by a plurality of substantially parallel and elongate plastic ribs which extend transversely between and are rigidly joined to said facing sheets, said ribs and sheets cooperating to define therebetween a plurality of elongated and substantially parallel channels which are enclosed between said facing sheets, the ribs and channels of a first of said inner and outer sheet-like layers being elongated substantially horizontally, and the ribs and channels of a second of said inner and outer layers being elongate substantially vertically;

one of said inner and outer sheet-like layers having an elongate groove formed therein with said groove extending in generally perpendicular relation to the ribs of said one layer and throughout substantially the entirety of the respective dimension, said groove opening inwardly through one of the facing sheets of said one layer and also through the ribs disposed thereunder with the bottom of the groove being closed by the other facing sheet of said one layer, said groove being confined entirely within the two-ply laminate so that the mouth of the groove is closed off by the other sheet-like layer; and an elongate metal reinforcing rod fixedly positioned within and substantially totally occupying said groove, said reinforcing rod being of a generally rectangular cross section and having a thickness less than the thickness of said one layer and a width which is significantly greater than the thickness of said one layer.

21. A bin according to claim 20, wherein said rod when disposed within said groove has a side surface which is substantially flush with said one facing sheet of said one layer and is adhesively secured to an opposed facing sheet of the other layer.

22. A bin according to claim 20, wherein said reinforcing rod is adhesively secured to both said inner and outer sheet-like layers.

23. A bin according to claim 22, wherein said one layer has a pair of said grooves formed therein with said grooves being disposed in generally parallel and sidewardly spaced relationship, each of said grooves having a said metal reinforcing rod fixedly positioned within the respective groove.

24. A bin according to claim 20, wherein said groove extends vertically.

25. A bin according to claim 20, wherein said groove extends horizontally.

26. A bin according to claim 20, wherein the other of said inner and outer sheet-like layers also has an elongate groove formed therein with said last-mentioned groove extending in generally perpendicular relation to the ribs of said other layer, said last mentioned groove opening inwardly through one of the facing sheets and also through the ribs disposed thereunder with the bottom of said last-mentioned groove being closed by the other facing sheet of said other layer, said last-mentioned groove being confined entirely within the two-ply laminate so that the mouth of said last-mentioned groove is closed off by said one sheet-like layer, and a further elongate metal reinforcing rod positioned within and substantially occupying said last-mentioned groove, said further reinforcing rod being of generally rectangular cross section and having a thickness less than the thickness of said other layer and a width which is significantly greater than the thickness of said other layer.

27. A bin according to claim 26, wherein said rods extend in generally perpendicular relationship to one another and have opposed faces which directly cross one another substantially at the interface between the inner and outer sheet-like layers.

* * * * *